US008661574B2

(12) United States Patent
Larsson

(10) Patent No.: US 8,661,574 B2
(45) Date of Patent: Mar. 4, 2014

(54) DRAIN AND INLET MEMBER FOR DRAIN

(75) Inventor: Hakan Larsson, Lund (SE)

(73) Assignee: Purus AB, Ystad (SE)

( * ) Notice: Subject to any disclaimer, the term of this patent is extended or adjusted under 35 U.S.C. 154(b) by 55 days.

(21) Appl. No.: 13/144,098

(22) PCT Filed: Feb. 10, 2009

(86) PCT No.: PCT/SE2009/050134

§ 371 (c)(1),
(2), (4) Date: Aug. 18, 2011

(87) PCT Pub. No.: WO2010/093290

PCT Pub. Date: Aug. 19, 2010

(65) Prior Publication Data

US 2011/0303595 A1 Dec. 15, 2011

(51) Int. Cl.
*A47K 3/00* (2006.01)

(52) U.S. Cl.
USPC ..... 4/287; 4/613

(58) Field of Classification Search
USPC ..... 52/302.1, 302.3, 302.6, 220.1; 210/163–166; 404/2–5; 405/118; 4/613, 679, 652, 287
See application file for complete search history.

(56) References Cited

U.S. PATENT DOCUMENTS

| | | | | |
|---|---|---|---|---|
| 5,022,430 | A * | 6/1991 | Degooyer | 137/362 |
| 5,878,448 | A * | 3/1999 | Molter | 4/613 |
| 6,687,925 | B2 * | 2/2004 | Minnick | 4/613 |
| 6,860,678 | B2 * | 3/2005 | Gunter | 405/118 |
| 7,264,418 | B1 * | 9/2007 | Houck et al. | 405/43 |
| 2007/0056088 | A1 * | 3/2007 | DeGooyer | 4/613 |
| 2008/0106094 | A1 | 5/2008 | Edelmayer | |

FOREIGN PATENT DOCUMENTS

| | | |
|---|---|---|
| CN | 85102349 | 1/1987 |
| DE | 202005019964 | 4/2006 |
| EP | 0763634 | 3/1997 |
| EP | 1577453 | 9/2005 |
| EP | 1782721 | 5/2007 |
| EP | 1818464 | 8/2007 |
| EP | 1854929 | 11/2007 |
| EP | 1908887 | 4/2008 |
| EP | 1914355 | 4/2008 |
| EP | 2085007 | 8/2009 |

* cited by examiner

*Primary Examiner* — Brian Glessner
*Assistant Examiner* — Beth Stephan
(74) *Attorney, Agent, or Firm* — Tarolli, Sundheim, Covell & Tummino LLP

(57) ABSTRACT

The present invention relates to a drain which comprises an inlet member (1), a grating (13) or cover plate laid loosely or detachably on top of the inlet member, and an outlet member (2). To achieve a short line of contact between the surface covering's sealing layer (6) and the drain while at the same time the sealing layer is fastened by means of a clamping ring (5) or a bonding flange, thereby reducing the risk of leakage and affording the possibility of connecting an aesthetically more pleasing inlet member (1), the inlet member (1) takes the form of an elongate or trilateral plate-like element (11) disposed on top of the sealing layer or the sealing layer (6) and the clamping ring (5) and provided with a recess (12) for flow communication with the outlet member (2). The present invention relates also to an inlet member (1) for a drain as above.

21 Claims, 8 Drawing Sheets

6
17
18
16
13a
13
13b
14
5
4
2a
8
2
2b
12
11
15
1
7

1
17
18
13a
14
13b
13
11
15
16
5
4
6
5b
21
21a
21b
7

DRAIN AND INLET MEMBER FOR DRAIN

RELATED APPLICATION

This application corresponds to PCT/SE2009/0050134, filed Feb. 10, 2009, the subject matter of which is incorporated herein by reference.

BACKGROUND TO THE INVENTION

The present invention relates to a drain.

The drain comprises an inlet member for connecting the drain to a surface covering, e.g. a floor covering, and an outlet member which is in flow communication with the inlet member in order to lead liquid via the inlet member from the surface covering to a drain system connected to the outlet member. The drain comprises also a grating or cover plate laid loosely or detachably on top of the inlet member.

The drain's outlet member has a seat for a clamping ring or a bonding flange in order thereby to clamp by means of the clamping ring or to adhesively bond on the bonding flange a sealing layer which is situated under the surface covering and leads down into, and is associated with, the outlet member, and an outlet stub which connects the outlet member to the drain system.

There are at present on the market a large number of mainly channel-like drains in different versions. These drains comprise substantially three elements, namely an inlet member in the form of a channel, an outlet member with or without water seal, and a frame with grating on top of the channel-like inlet member. The connection of a sealing layer to the channel-like inlet member is either by means of a bonding flange or by means of a clamping frame. The channel occupies a large volume and the sealing layer connection runs along the whole frame, entailing risk of leakage.

The present invention relates also an inlet member for a drain.

BRIEF SUMMARY OF THE INVENTION

The object of the present invention is to propose a drain with a shorter line of contact between the sealing layer and the drain while at the same time the sealing layer is fastened by means of a clamping ring. The result is less risk of leakage and the possibility of connecting an aesthetically more pleasing inlet member, e.g. an inlet member resembling a channel, to a conventional drain.

This object is achieved primarily by the inlet member as defined above being configured as an elongate or trilateral plate-like element disposed on top of the sealing layer, or the sealing layer and the clamping ring, and provided with a recess for flow communication with the outlet member.

The object of the present invention is also to propose an inlet member as above for use in the renovation of wet spaces with existing drains.

The fitting of the inlet member is substantially simplified by the plate-like element according to further versions of the invention taking the form of a separate element disposed loosely on top of the sealing layer or the sealing layer and the clamping ring and fixed at least laterally by means of the surface covering.

Other objects and advantages of the present invention will be apparent to one skilled in the art who studies the attached drawings and the following detailed description of a suitable embodiment thereof.

BRIEF DESCRIPTION OF THE DRAWINGS

Lastly.

DETAILED DESCRIPTION OF PREFERRED EMBODIMENTS OF THE INVENTION

Figure 5:
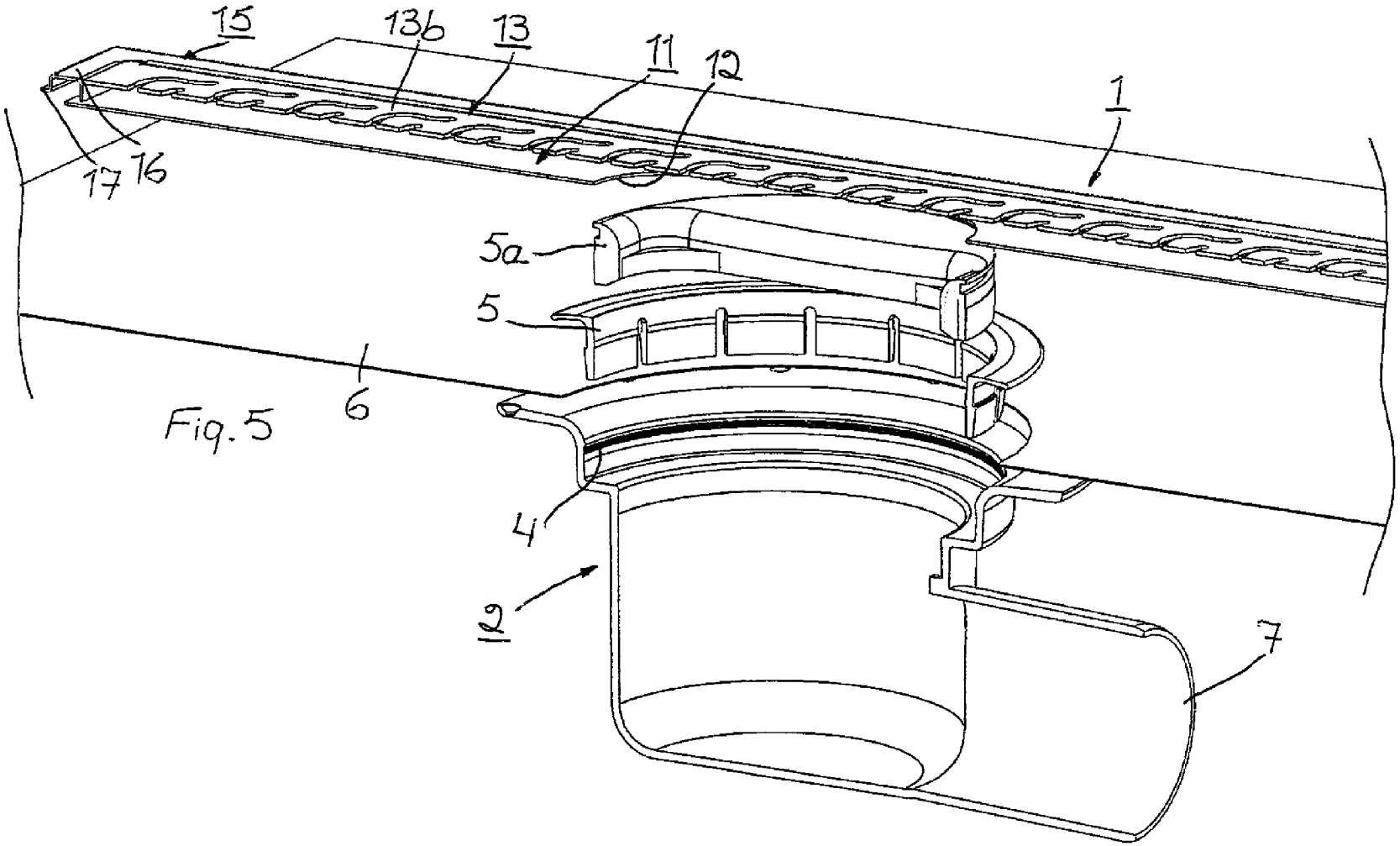
FIG. 5 is an exploded view in perspective, cut away in the longitudinal direction, of the drain according to FIG. 4 with the inlet member according to FIGS. 1-4.
Figure 6:
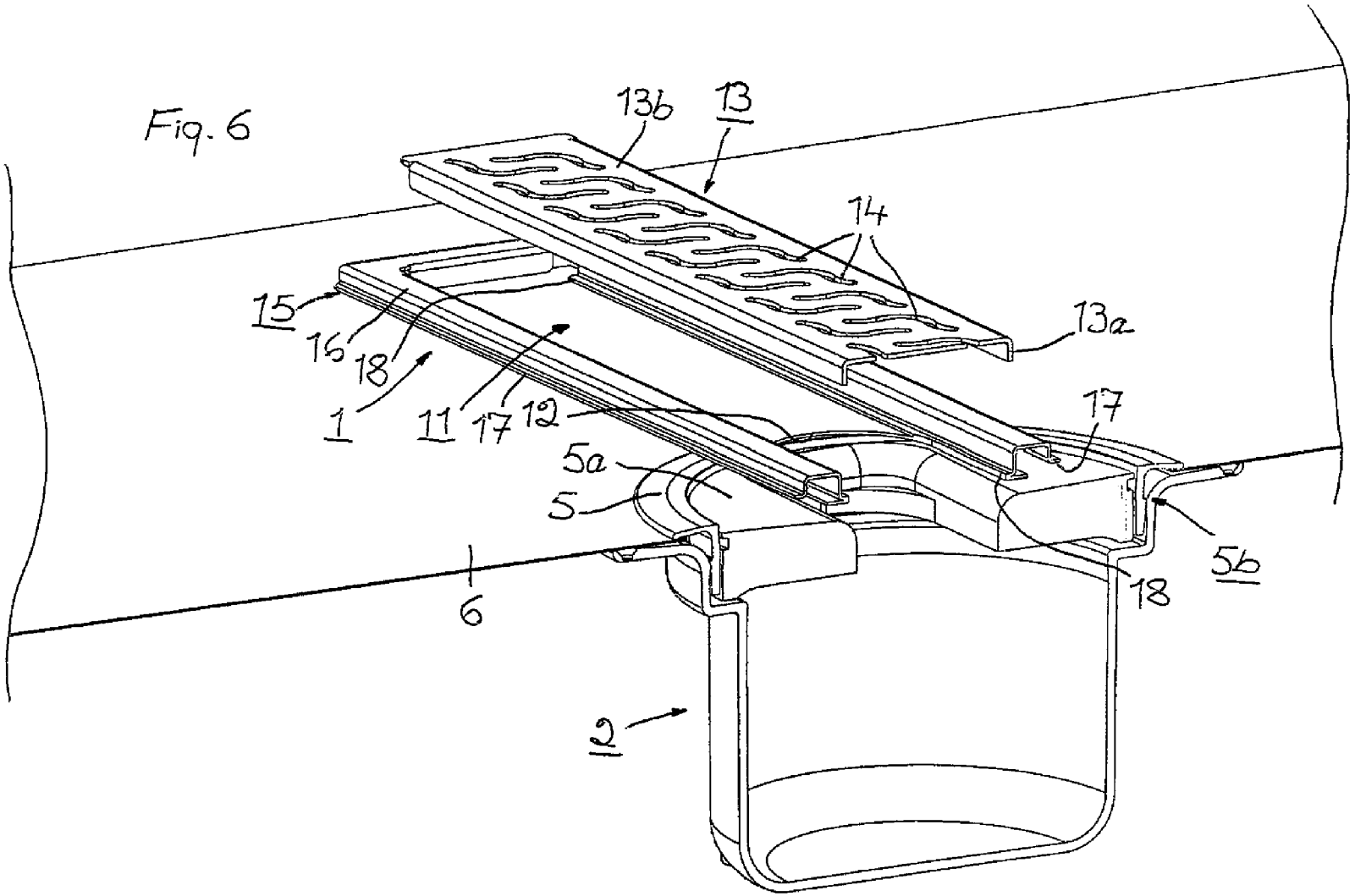
FIG. 6 is an alternative exploded view in perspective, cut away in the transverse direction, of the drain according to FIGS. 4 and 5 with the inlet member according to FIGS. 1-5.
Figure 7:
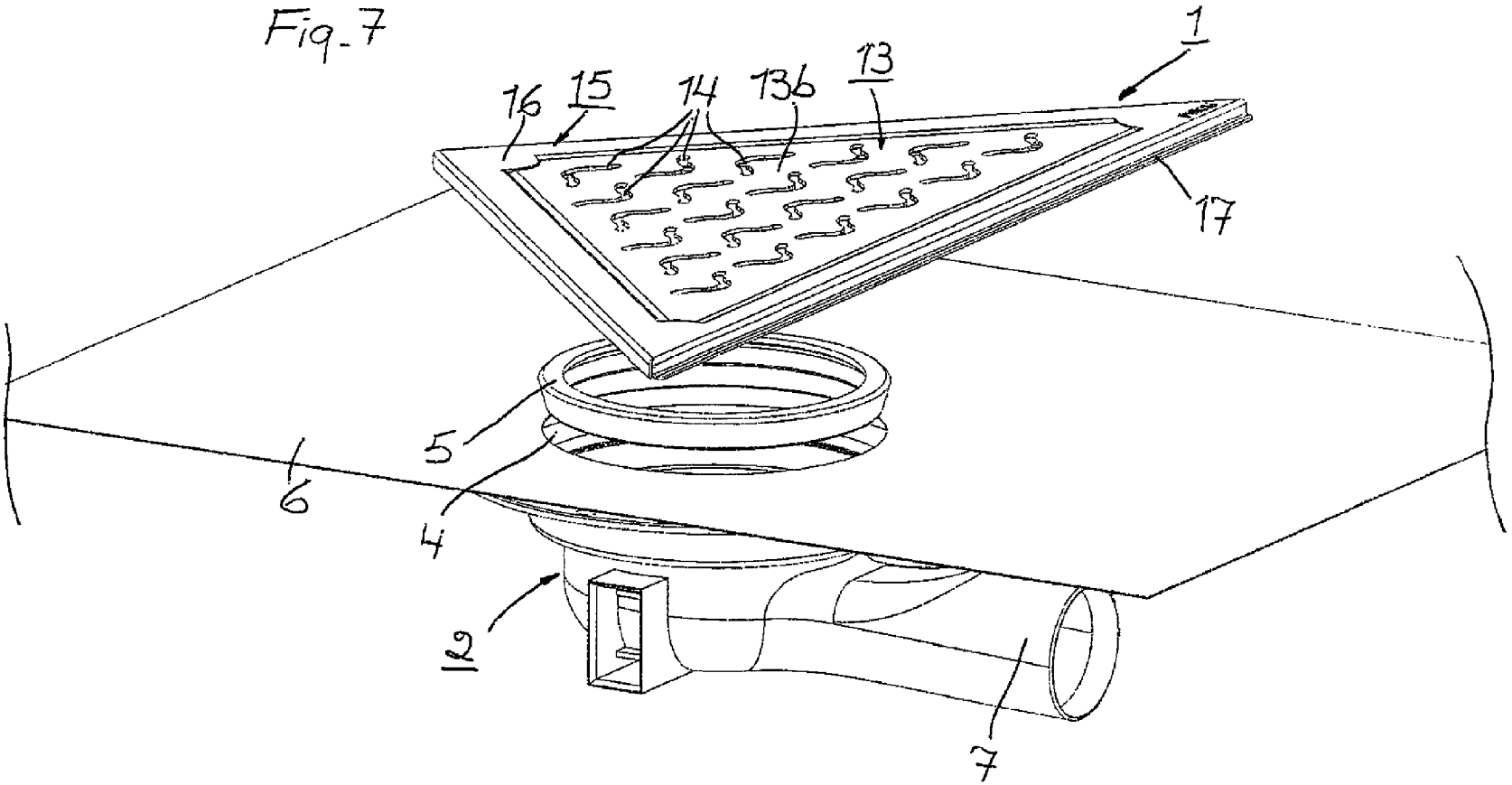
FIG. 7 is an exploded view in perspective of a further alternative version of the drain according to the present invention with another version of the inlet member according to the present invention.
Figure 8:
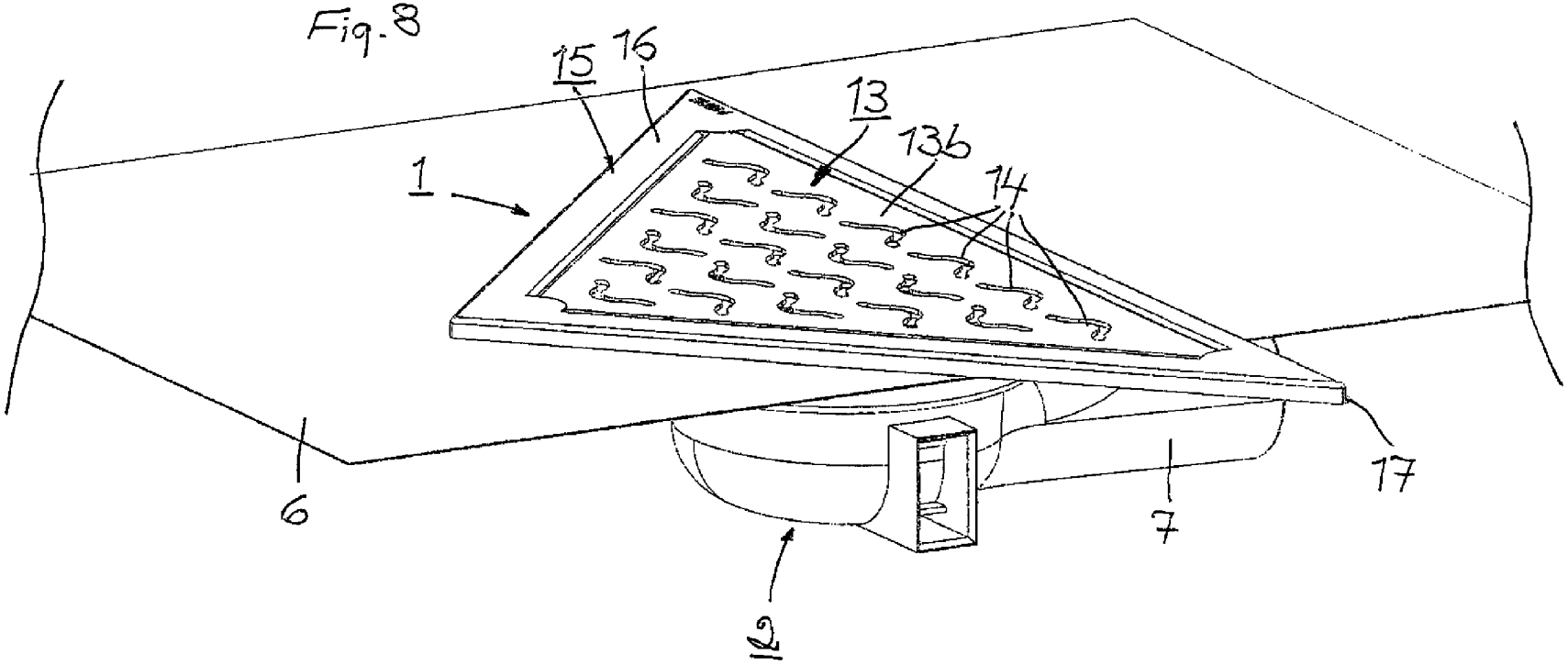
FIG. 8 depicts a view in perspective of the drain according to FIG. 7 and the inlet member which forms part thereof.

FIGS. 1-6 thus depict in transverse and longitudinal sections and in perspective two embodiments of a drain according to the present invention with one kind of inlet member, whereas FIGS. 7 and 8 depict a third embodiment of the drain with another kind of inlet member. The inlet members 1 of the drains are also part of the present invention. Each drain comprises not only the inlet member 1 but also an outlet member 2. The inlet member 1 is intended to connect the drain to an undepicted surface covering, e.g. a floor covering. The floor covering may for example consist of clinkers. The outlet member 2 is in flow communication with the inlet member 1 in order to lead liquid via the inlet member from the surface covering to a drain system (not depicted) which is connected to the outlet member.

Figure 3:
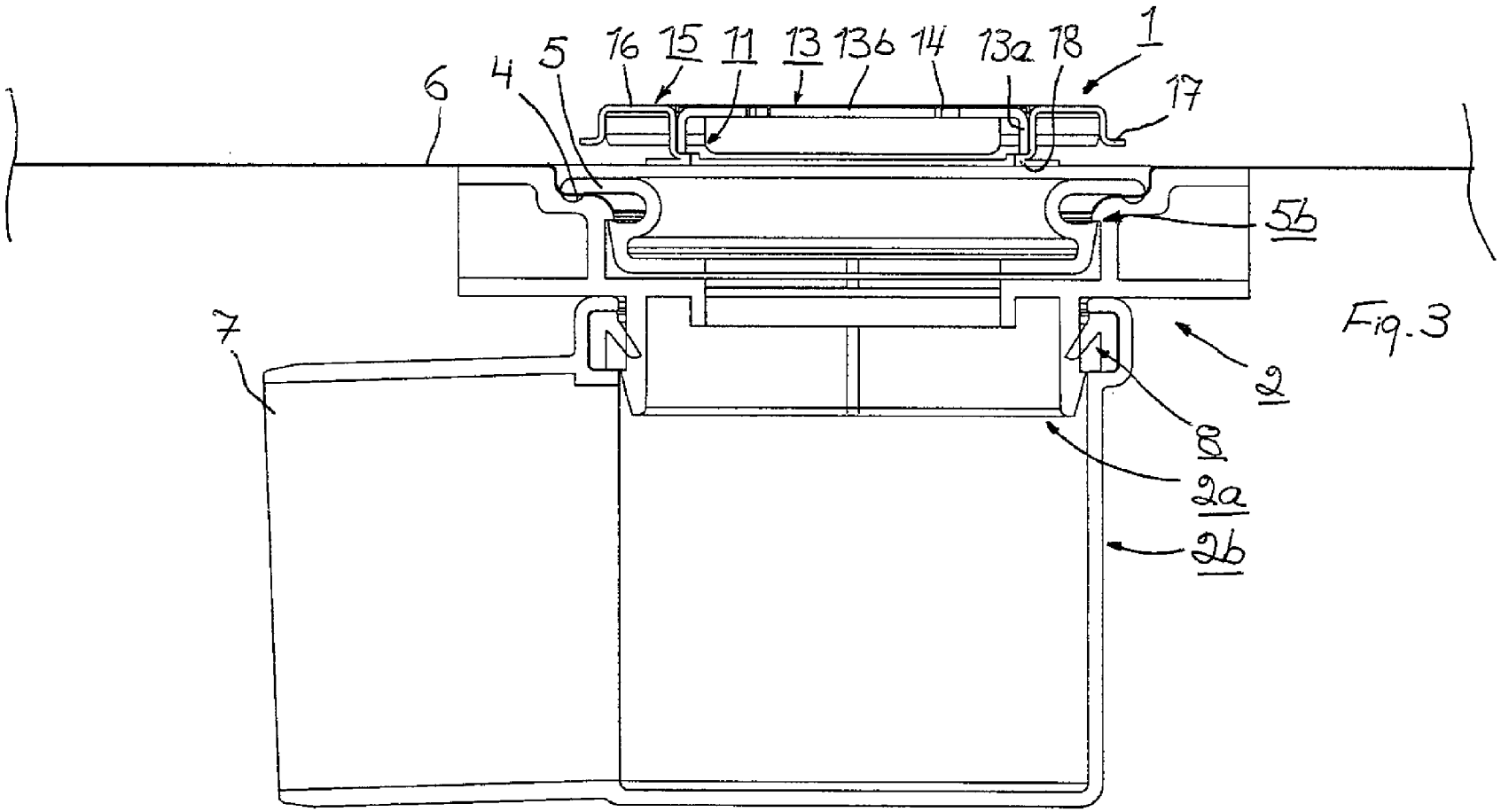
FIG. 3 is a cross-section through the drain according to FIG. 1.
Figure 4:
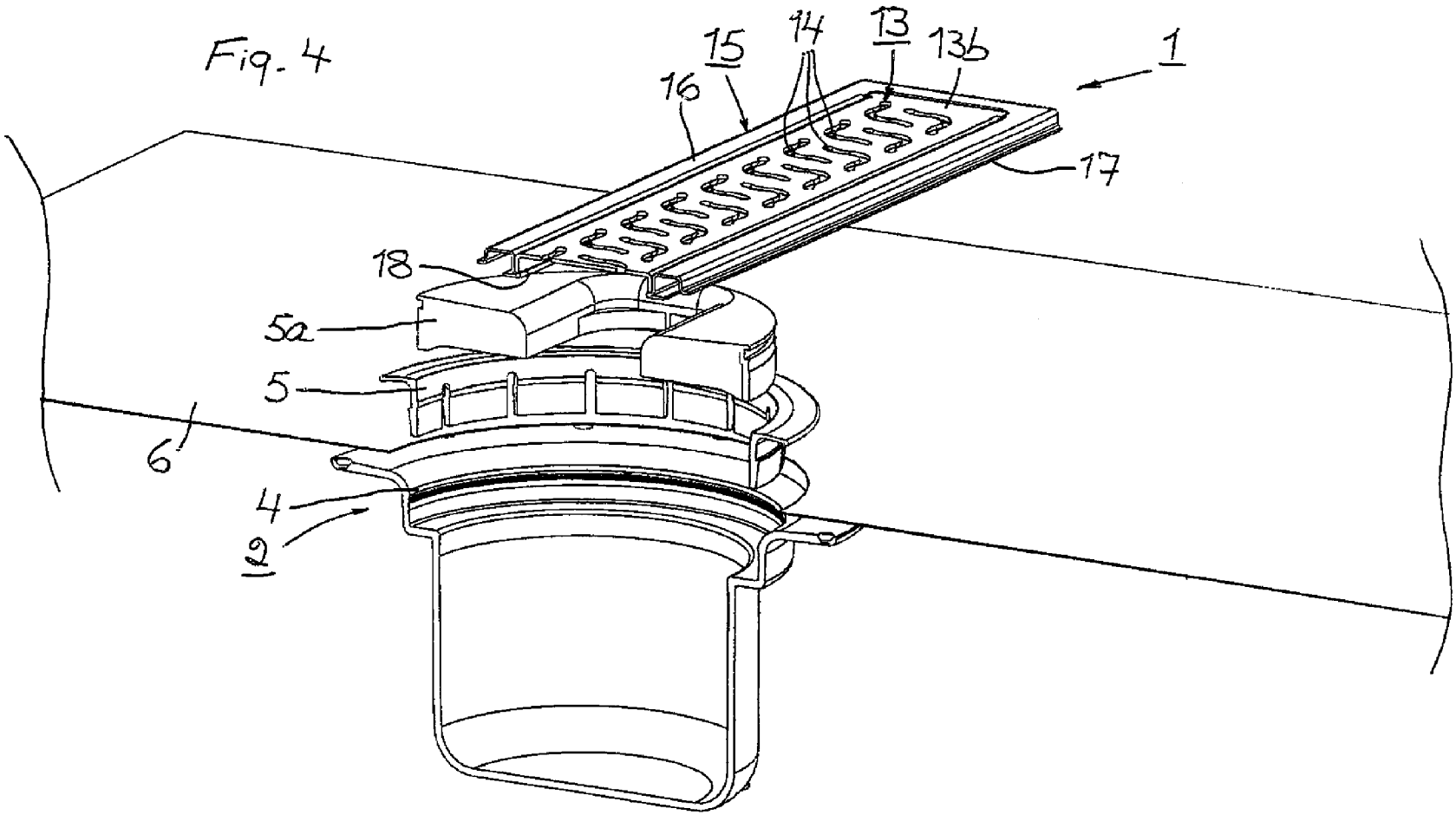
FIG. 4 is an exploded view in perspective, cut away in the transverse direction, of an alternatively configured drain according to the present invention with the inlet member according to FIGS. 1-3.

The outlet member 2 may, as in the drawings, have a seat 4 for a clamping ring 5 or alternatively have a bonding flange. In order thereby to clamp by means of the clamping ring or to adhesively bond on the bonding flange a sealing layer 6 which is situated under the surface covering and leads down into, and is associated with, the outlet member. The outlet member 2 also has an outlet stub 7 which connects the outlet member to the drain system. The seat 4 for the clamping ring 5 or the bonding flange delineates an inlet to the outlet member 2 via which the outlet member is in flow communication with the inlet member 1. In the drain version depicted in FIGS. 1-3, the seat 4 of the outlet member 2 for the clamping ring 5 (or for the bonding flange of the outlet member) and the outlet stub 7 take the form of two separate elements 2*a*, 2*b* of the outlet member. In the version depicted, these two elements 2*a*, 2*b* of the seat 4 for the clamping ring 5 (or for the bonding flange) and the outlet stub 7 are connected to one another by a snap connection 8, but they may also be connected together in some other way or simply be formed integrally. The outlet member 2 is also suitably configured or provided with a water seal unit (not depicted) of a suitable type depending on, for example, whether the drain's outlet member 2 has a laterally directed outlet stub 7 as in the drawings or alternatively the drain is bottom-emptying. The outlet member 2, the seat 4 for the clamping ring and the clamping ring 5, or the bonding flange, and the inlet to the outlet member which is delineated by the seat or the bonding flange are substantially circular, as in FIGS. 4-6, or of elliptical configuration as in the version according to FIGS. 1-3, but they may also be of any other suitable shape. In FIGS. 4-6, the outlet member 2, the seat 4 for the clamping ring and the clamping ring 5 are therefore substantially circular, but the clamping ring is supplemented by an insert 5*a* with an elliptical aperture. This arrangement makes it easy to connect an inlet member 1 which has an elliptical aperture or recess to an existing older drain with a circular seat 4 for a clamping ring 5. The clamping ring 5 may if so desired be snapped firmly to the seat 4 (at 5*b*), just as the clamping ring unit 5*a* may be snapped firmly to the clamping ring. The water seal unit may also be of circular or elliptical or some other suitable shape. The water seal unit may also itself be formed of two elements connected to one another by, for example, a snap connection.

Figure 1:
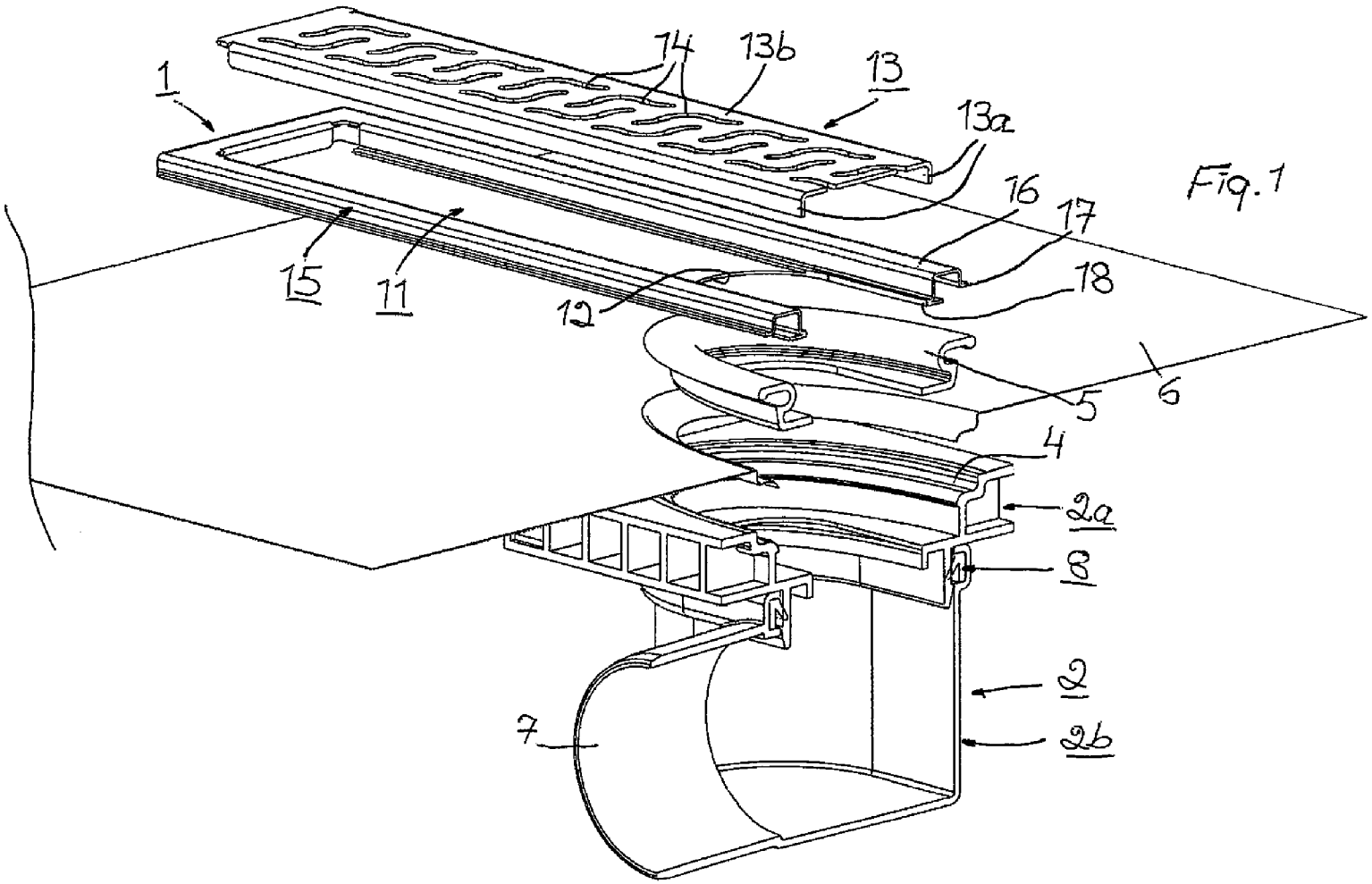
FIG. 1 is an exploded view in perspective, cut away in the transverse direction, of a drain according to the present invention with one of a number of suitable versions of an inlet member according to the present invention for the drain.
Figure 2:
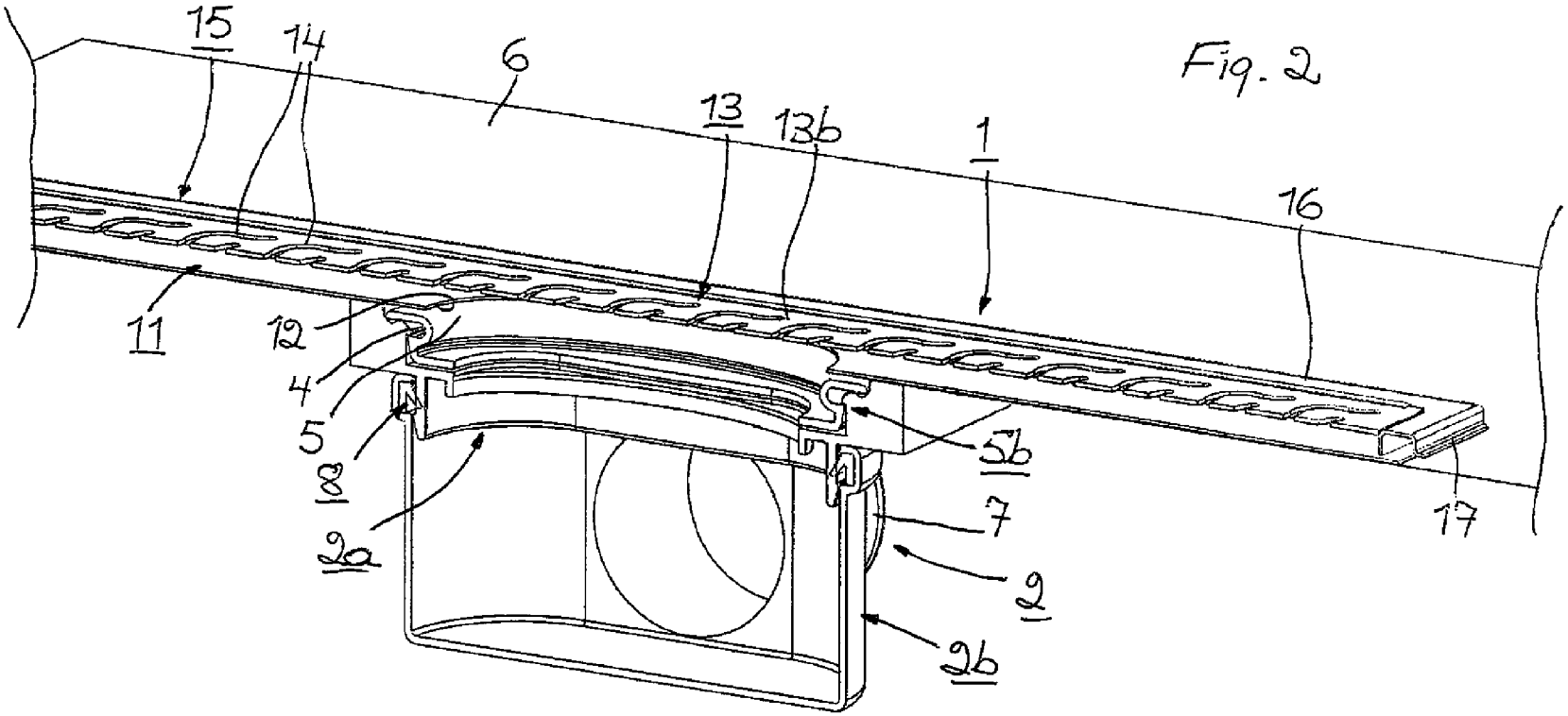
FIG. 2 illustrates in perspective view, cut away in the longitudinal direction, the drain according to FIG. 1 with the inlet member thereto.

The inlet member 1 according to the invention takes the form of a plate-like element 11 which is elongated (FIGS. 1-6) or trilateral (FIGS. 7 and 8), disposed on top of the sealing layer or the sealing layer 6 and the clamping ring 5 and provided with a recess 12 for flow communication with the outlet member 2. The recess 12 in the version according to FIGS. 1-3 is of elliptical shape corresponding to the outlet member 2 and, above all, corresponding to the seat 4 for the clamping ring 5 (or the bonding flange) thereon and/or the inlet to the outlet member which is delineated by the seat (or by the bonding flange). In the version according to FIGS. 4-3, the recess 12 is also of elliptical shape corresponding to the clamping ring insert 5*a*. The recess 12 may of course also be of circular configuration or any other suitable shape. The version described above of the drain's inlet and outlet members 1, 2 achieves, as previously mentioned, a short line of contact between the sealing layer 6 and the drain while at the same time the sealing layer is fastened by the clamping ring 5 (or is bonded firmly to the bonding flange), thereby reducing the risk of leakage and affording the possibility of connecting an aesthetically more pleasing inlet member 1, e.g. an inlet member resembling a channel, to even a conventional drain.

It is possible to connect to the elliptically configured recess 12 in the plate-like element 11 in the versions depicted a runoff portion (not depicted) which leads from the recess down into the outlet member 2.

Lastly, the drain comprises also a grating 13 or cover plate (not depicted) laid loosely or detachably on top of the inlet member 1. The plate-like element 11 or the cover plate thus laid loosely or detachably on top of the inlet member 1 in the form of the plate-like element 11 may be of a type with substantially ⊓-shaped cross-section so that the grating or the cover plate rests via the side limbs 13*a* on the plate-like element 11, thereby delineating an intermediate space for liquid flow between the plate-like element 11 and the web portion 13*b* of the grating or the cover plate. At least the cover plate's side limbs have apertures or recesses or take the form of mutually spaced legs, e.g. one leg at at least each corner of a rectangular cover plate, to allow liquid to pass. The web portion 13*b* of the grating 13 also has perforations 14 in a suitably functional and aesthetically pleasing version for liquid to pass from the surface covering down to the plate-like element 11. The grating 13 or the cover plate may in an alternative undepicted version thereof be entirely planar and the plate-like element 11 may instead be provided with, for example, a peripheral spacer for primarily the grating or a number of shorter spacers for both the grating and the cover plate. The combined height of the spacer or spacers and the grating 13 or the cover plate corresponds substantially to the height of the surface covering. The spacer or spacers may be disposed on or be integral with the plate-like element 11.

The plate-like element 11 or at least its upper side may with advantage be configured to slope towards the recess 12 to facilitate the runoff of liquid down into the outlet member 2. The recess 12 in the versions depicted in FIGS. 1-6 is disposed centrally in the elongate plate-like element 11 in the latter's longitudinal direction, but may of course alternatively be disposed nearer to one or other end of the elongate plate-like element 11.

The plate-like element 11 in the versions depicted in FIGS. 1-6 is of substantially rectangular shape. The plate-like element 11 may thus be configured with length and width corresponding to the length and width of conventional drain channels. In FIGS. 7 and 8, the plate-like element 11 is trilateral.

The plate-like element 11 in the drawings takes the form of a separate element disposed loosely on top of the sealing layer or the sealing layer 6 and the clamping ring 5. Separate here means that the inlet member 1 is in no way assembled with, i.e. screwed or snapped to, the outlet member 2. Nor is the inlet member 1 in the version depicted in any way fastened to the sealing layer 6. The inlet member 1 can therefore with advantage also easily be fitted alone to existing drains, e.g. in wet spaces being renovated or at least being provided with a new surface covering, without it being necessary to remove existing drain parts which are, for example, cast in or fastened in some other way in the floor structure. The plate-like element 11 may instead, in order to be assembled with the outlet member 2 or fastened to the sealing layer 6, be so configured that it is kept at least laterally fixed by the surface covering. The plate-like element 11 and/or the grating 13 may thus be prevented from being dislaid horizontally by the surface covering, e.g. said clinkers. The surface covering or the grating 13 or the cover plate may in such cases be of the same size, i.e. in the versions depicted in FIGS. 1-6 they may be of the same width and the same length. If on the contrary it is desired that it should not be possible to pull up the plate-like element 11, the latter, in the versions depicted in FIGS. 1-6, may for example be configured so much wider and/or so much longer than the grating 13 or the cover plate as to make it possible for the surface covering to be laid on top of portions of the plate-like element which protrude beyond the grating or the cover plate. It should be noted here that where a cover plate is used, the plate-like element 11 in the versions depicted in FIGS. 1-6 should with advantage always be at least somewhat wider to create at least one runoff slit in at least the longitudinal direction of the plate-like element and the cover plate. The height of the grating 13 or the cover plate is substantially the same as the height of the surface covering, i.e. the height of the side limbs 13*a* or legs of the grating 13 or the cover plate is substantially the same as the height of the surface covering.

To further ensure reliable runoff without leakage, the plate-like element 11 may be provided with a peripheral elevation 15 within which the grating 13 or the cover plate is laid loosely or detachably. This peripheral elevation 15 is of substantially the same height as the grating 13 or the cover plate and thus also of substantially the same height as the surface covering, i.e. a height of about 4-7 mm in the case of a surface covering composed of clinkers.

The peripheral elevation 15 delineates an elongate space running in the longitudinal direction of the plate-like element 11, or a trilateral space, for the grating 13 or the cover plate. In the elongate versions of the plate-like element 11 depicted in FIGS. 1-6, this space is substantially rectangular, whereas in the version according to FIGS. 7 and 8 it is trilateral.

The peripheral elevation 15 may be disposed on or be integral with the plate-like element 11. The elevation 15 may, as in the versions depicted in the drawings, take the form of a suitably shaped profile 16 or quite simply take the form of a flange extending substantially vertically upwards from the plate-like element 11. The elevation 15 has on the outside in the versions depicted, on its side which faces away from the space for the grating 13 or the cover plate, a flange 17 extending substantially horizontally outwards. This flange 17 is used as a fastening or contact surface on which the surface covering is laid for fixing the plate-like element 11 not only laterally but also so that the surface covering prevents pulling up of the plate-like element 11. An effective leak-free connection between the plate-like element 11 and the surface covering is thus achieved. The flange 17 may, as depicted in the drawings, may be peripheral, it may as also depicted in the drawings run along the long or short sides of the plate-like element 11 or there may be a plurality of shorter flange portions round the elevation. A second flange 18 or shorter flange portions for the grating 13 or the cover plate may be disposed at a suitable height on the inside of the profile 16 or the like in cases where, for example, the grating or the cover plate has shorter side limbs or legs or in cases where the grating or the cover plate is entirely planar.

Where a cover plate is used on top of the plate-like element 11, the size of the space delineated by the peripheral elevation 15 in which the cover plate is laid may, as above, exceed the size of the cover plate to create a slit between the elevation and the cover plate. In the versions depicted in FIGS. 1-6, it is therefore advantageous that at least the width of the space should exceed the width of the cover plate so that a longitudinal slit is formed on two sides between the elevation 15 and the cover plate.

The peripheral elevation 15 may alternatively constitute a spacer as above for a substantially planar grating 13, in which case the grating is therefore laid on top of the elevation.

One or more spacers as above for a substantially planar grating or cover plate may also be disposed within the peripheral elevation 15, in the space delineated by the latter, in which case the elevation is with advantage used exclusively for, for example, tight and effective connection to a surrounding surface covering.

It will be obvious to one skilled in the art that in addition to what is indicated above the present invention may be modified or altered within the scope of the claims set out below without departing from the idea and objects of the invention. Thus, for example, the drain's constituent inlet and outlet members, the grating or the cover plate and the inlet member itself may be made of plastic or metal. They may of course also vary in size depending on the application. The runoff portion of the plate-like element, the spacer or spacers for it, the elevation etc. may be configured in many different ways.

The invention claimed is:

1. A drain system comprising:

an inlet member (1) having an opening therein and a floor covering, the inlet member opening provides a flow communication between the floor covering and a drain, one of a grating (13) and cover plate on top of the inlet member, an outlet member (2) below and in flow communication with the inlet member to allow liquid to flow thru the opening in the inlet member from the floor covering to the outlet member, the outlet member has a seat (4), a clamping ring (5), and a sealing layer below the floor covering and above the outlet member, the clamping ring clamping the sealing layer between the seat and the clamping ring, the sealing layer (6) extends down into the outlet member, and an outlet stub (7) which connects the outlet member to the drain, wherein the inlet member (1) comprises an element (11) disposed on top of the sealing layer (6) and the clamping ring (5) and provided with a peripheral elevation (15) for lateral fixation of the inlet member by means of the floor covering, and provided with a recess (12) for flow communication with the outlet member (2).

2. A drain system according to claim 1, wherein the element (11) is of substantially rectangular shape.

3. A drain system according to claim 1, wherein the drain is a floor drain with the inlet member (1) kept substantially laterally fixed by the floor covering comprising clinkers.

4. A drain system according to claim 1, wherein the element (11) is configured to slope towards the recess (12).

5. A drain system according to claim 1, wherein the element (11) has a runoff portion leading from the recess (12) down into the outlet member (2).

6. A drain system according to claim 1, wherein the element (11) has at least one spacers for the one of the grating (13) and the cover plate.

7. A drain system according to claim 1, wherein the peripheral elevation (15) is configured for detachable location of the one of the grating (13) and the cover plate on top thereof.

8. A drain system according to claim 1, wherein the peripheral elevation (15 is configured for detachable location of the one of the grating (13) and the cover plate within said peripheral elevation.

9. A drain system according to claim 8, wherein the peripheral elevation (15) is of substantially the same height as the one of the grating (13) and the cover plate.

10. A drain system according to claim 7, wherein the height of the peripheral elevation (15) is substantially the same as the height of the floor covering.

11. A drain system according to claim 8, wherein the peripheral elevation (15) delineates a space running in the longitudinal direction of the element (11) for the one of the grating (13) and the cover plate.

12. A drain system according to claim 11, wherein the space, delineated by the peripheral elevation (15) is substantially rectangular.

13. A drain system according to claim 11, wherein the size of the space delineated by the peripheral elevation (15) exceeds the size of the cover plate laid in the space, in order to create a slit between said elevation and the cover plate.

14. A drain system according to claim 1, wherein the seat extends radially inwardly from a first cylindrical portion of the outlet member.

15. A drain system according to claim 14, wherein the clamping ring has a radially outer surface engaging the sealing layer clamping the sealing layer to the seat.

16. A drain system according to claim 14, wherein the outlet member includes a first element having the seat and a second element, the first cylindrical portion extending into and coaxially with a second cylindrical portion of the second element.

17. A drain system according to claim 16, wherein the first element has a snap connection with the second element.

18. A drain system according to claim 1, wherein the clamping ring has a snap connection with the outlet member.

19. A drain system, comprising:

an inlet member, a floor covering, and a sealing layer below the floor covering, the inlet member having an opening providing flow communication between the floor covering and a drain, the inlet member including an element disposed on top of the sealing layer;

one of a grating and a cover plate on top of the inlet member;

an outlet member in flow communication with the opening in the element, the outlet member having a recess providing flow communication from the floor covering to the drain; and a clamping ring extending into a seat of the outlet member, the clamping ring clamping the sealing layer between the seat and the clamping ring and clamping the sealing layer to the outlet member so that the sealing layer extends down into the outlet member.

20. A drain system according to claim 19, wherein the seat extends radially inwardly from a first cylindrical portion of the outlet member, the clamping ring having a radially outer surface engaging the sealing layer clamping the sealing layer to the seat.

21. A drain system according to claim 20, wherein the outlet member includes a first element having the seat and a second element, the first cylindrical portion extending into and coaxially with a second cylindrical portion of the second element, the first element having a snap connection with the second element, the clamping ring having a snap connection with the first element of the outlet member.

* * * * *